US010193205B2

(12) United States Patent
Yuan et al.

(10) Patent No.: US 10,193,205 B2
(45) Date of Patent: Jan. 29, 2019

(54) DIELECTRIC RESONATOR, DIELECTRIC FILTER USING DIELECTRIC RESONATOR, TRANSCEIVER, AND BASE STATION

(71) Applicant: Huawei Technologies Co., Ltd., Shenzhen (CN)

(72) Inventors: Bengui Yuan, Shanghai (CN); Qiang Wang, Shanghai (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 14/960,139

(22) Filed: Dec. 4, 2015

(65) Prior Publication Data

US 2016/0099492 A1 Apr. 7, 2016

Related U.S. Application Data

(63) Continuation of application No. PCT/CN2013/076732, filed on Jun. 4, 2013.

(51) Int. Cl.
*H01P 7/10* (2006.01)
*H01P 1/208* (2006.01)
*H01P 1/20* (2006.01)

(52) U.S. Cl.
CPC ..... *H01P 7/10* (2013.01); *H01P 1/2002* (2013.01); *H01P 1/2084* (2013.01)

(58) Field of Classification Search
CPC ..... H01P 1/2084; H01P 1/208; H01P 1/2086; H01P 7/10; H01P 7/105
(Continued)

(56) References Cited

U.S. PATENT DOCUMENTS 4,691,179 A 9/1987 Blum et al.
5,537,082 A * 7/1996 Tada ..... H01P 1/2056 333/202
(Continued)

FOREIGN PATENT DOCUMENTS

CN 1236197 A 11/1999
CN 202121036 U 1/2012
(Continued)

OTHER PUBLICATIONS

Sano, K., "Application of the Planar I/O Terminal to Dual-Mode Dielectric-Waveguide Filters," IEEE Transactions on Microwave Theory and Techniques, vol. 48, No. 12, Dec. 2000, 5 pages.
(Continued)

*Primary Examiner* — Stephen E Jones
(74) *Attorney, Agent, or Firm* — Slater Matsil, LLP

(57) ABSTRACT

Embodiments of the present disclosure provide a dielectric resonator, a dielectric filter using the dielectric resonator, a transceiver, and a base station, and solve a problem that a loss indicator of an existing dielectric filter cannot meet a filtering requirement of a base station. The dielectric resonator includes a body made of a solid-state dielectric material, where an indentation is disposed on a surface of the body, and the surface of the body and a surface of the indentation are covered with a conducting layer; the dielectric filter includes at least two of the foregoing dielectric resonators. Another type of dielectric filter includes a body made of a solid-state dielectric material, where at least two indentations are disposed on a surface of the body, a hole and/or a groove is disposed between adjacent indentations on the body, and the surface of the body is covered with a conducting layer.

19 Claims, 4 Drawing Sheets

(58) Field of Classification Search
USPC .... 333/202, 219, 219.1, 230, 231, 227, 212, 333/208, 209
See application file for complete search history.

(56) References Cited

U.S. PATENT DOCUMENTS

| | | | | |
|---|---|---|---|---|
| 8,823,470 | B2 * | 9/2014 | Vangala | H01P 1/2088 333/212 |
| 9,406,993 | B2 * | 8/2016 | Hendry | H01P 1/2088 |
| 2004/0021532 | A1 | 2/2004 | Jang | |
| 2004/0155732 | A1 | 8/2004 | Fukunaga | |

FOREIGN PATENT DOCUMENTS

| | | | |
|---|---|---|---|
| EP | 0856902 | A2 | 8/1998 |
| EP | 0951089 | A2 | 10/1999 |
| JP | S581301 | A | 1/1983 |
| JP | H01115302 | U | 8/1989 |
| JP | H03292006 | A | 12/1991 |
| JP | H04103202 | A | 4/1992 |
| JP | H04150101 | A | 5/1992 |
| JP | H06177608 | A | 6/1994 |
| JP | H07135411 | A | 5/1995 |
| JP | H08204413 | A | 8/1996 |
| JP | H10224115 | A | 8/1998 |
| JP | 2000165106 | A | 6/2000 |
| JP | 2003032005 | A | 1/2003 |
| JP | 2004519913 | A | 7/2004 |
| JP | 2004247843 | A | 9/2004 |
| JP | 2007184868 | A | 7/2007 |
| JP | A2007295361 | A | 11/2007 |
| WO | 2008019307 | A2 | 2/2008 |

OTHER PUBLICATIONS

Konishi, Y. et al., "Design and Application of Filter Circuit for Communications," General Electronics Publishers, issued on Feb. 1, 1994, 7 pages.

Vakashima, M., "Microwave Engineering—Fundamentals and Principles," Morikita Publishing Co., Ltd., Chapter 2 Microwave Transmission Line (No. 1), Apr. 15, 1975, 14 pages.

* cited by examiner

DIELECTRIC RESONATOR, DIELECTRIC FILTER USING DIELECTRIC RESONATOR, TRANSCEIVER, AND BASE STATION

This application is a continuation of International Application No. PCT/CN2013/076732, filed on Jun. 4, 2013, which is hereby incorporated by reference in its entirety.

TECHNICAL FIELD

Embodiments of the present disclosure relate to communications device components, and in particular, to a dielectric resonator, a dielectric filter using the dielectric resonator, a transceiver, and a base station.

BACKGROUND

With the development of wireless communications technologies, wireless communications base stations are more densely distributed, imposing increasingly strong requirements for miniature base stations. A radio frequency front-end filter module in a base station occupies a relatively large volume; therefore, using a filter with a smaller volume plays an important role in reducing the volume of the base station.

There are many types and forms of filters, among which, a dielectric filter has a relatively small volume. FIG. 1 shows an existing dielectric filter. A body of the dielectric filter is a dielectric 11 in a rectangular shape, where a through hole 12 is disposed in the dielectric 11, one end of the through hole 12 is exposed from the front face of the dielectric 11, and the front face of the dielectric 11 is partially metalized, that is, a square metal layer 13 is formed only on a dielectric 11 surface surrounding the end of the through hole 12, adjacent square metal layers 13 are electrically insulated, and except the front face, all other surfaces of the dielectric 11 are metalized (in FIG. 1, shadowed parts are metalized areas, and unshadowed parts are non-metalized areas). One through hole 12 and the square metal layer 13 surrounding the end of the through hole 12 on the front face of the dielectric 11 form one dielectric resonator, where a resonance frequency of the dielectric resonator is adjusted by adjusting an area of the square metal layer 13, and coupling between adjacent dielectric resonators is adjusted by adjusting a distance between the adjacent square metal layers 13.

In the foregoing dielectric filter, an inner resonance mode of the dielectric resonator is a TEM (Transverse Electromagnetic) mode, and loss of an inner conductor is large, which leads to large loss of the dielectric filter. As a result, a loss indicator of the dielectric filter cannot meet a filtering requirement of a base station.

SUMMARY

Embodiments of the present disclosure provide a dielectric resonator, a dielectric filter using the dielectric resonator, a transceiver, and a base station, which solve a problem that a loss indicator of an existing dielectric filter cannot meet a filtering requirement of a base station because an inner resonance mode of a dielectric resonator in the dielectric filter is a TEM mode.

To achieve the foregoing objective, the embodiments of the present disclosure use the following technical solutions.

According to a first aspect, an embodiment of the present disclosure provides a dielectric resonator, including a body made of a solid-state dielectric material, where a dent is disposed on a surface of the body, and the surface of the body and a surface of the dent are covered with a conducting layer.

With reference to the first aspect, in a first possible implementation manner of the first aspect, the number of dents is one.

With reference to the first aspect or the first possible implementation manner of the first aspect, in a second possible implementation manner, the dielectric material is ceramic.

According to a second aspect, an embodiment of the present disclosure provides a dielectric filter, including at least two dielectric resonators, where the dielectric resonator includes a body made of a solid-state dielectric material, a dent is disposed on a surface of the body, and the surface of the body and a surface of the dent are covered with a conducting layer.

With reference to the second aspect, in a first possible implementation manner of the second aspect, adjacent dielectric resonators are fixedly connected by using joint faces, and conducting layers of the joint faces are connected together.

With reference to the second aspect or the first possible implementation manner of the second aspect, in a second possible implementation manner of the second aspect, there is a spacing between the adjacent dielectric resonators.

With reference to the second implementation manner of the second aspect, in a third implementation manner of the second aspect, a shape of the spacing is a hole or a groove.

According to a third aspect, an embodiment of the present disclosure provides a dielectric filter, including a body made of a solid-state dielectric material, where at least two dents are disposed on a surface of the body; a hole and/or a groove is disposed between adjacent dents on the body; and the surface of the body is covered with a conducting layer.

With reference to the third aspect, in a first implementation manner of the third aspect, one dent, the body surrounding the one dent, and the conducting layer surrounding the one dent form a dielectric resonator.

With reference to the third aspect or the first implementation manner of the third aspect, in a second implementation manner of the third aspect, the hole and/or the groove forms a coupled structure between adjacent dielectric resonators.

With reference to the third aspect or the first or the second possible implementation manner of the third aspect, in a third possible implementation manner of the third aspect, the hole is a through hole or a blind hole.

According to a fourth aspect, an embodiment of the present disclosure provides a transceiver, including the foregoing dielectric filter.

According to a fifth aspect, an embodiment of the present disclosure provides a base station, including the foregoing transceiver.

In the dielectric resonator, the dielectric filter using the dielectric resonator, the transceiver, and the base station provided in the embodiments of the present disclosure, a dent on a body of the dielectric resonator, and a conducting layer covering a surface of the body and a surface of the dent form a resonant cavity. A resonance mode inside the resonant cavity is a TM (transverse magnetic) mode, and an electric field direction of the mode is perpendicular to a body surface on which the dent is located. Because there is no inner conductor loss inside the resonant cavity, loss of the dielectric resonator is relatively small, so that a loss indicator of the dielectric filter using the dielectric resonator can meet a filtering requirement of a base station.

BRIEF DESCRIPTION OF THE DRAWINGS

To describe the technical solutions in the embodiments of the present disclosure or in the prior art more clearly, the following briefly introduces the accompanying drawings required for describing the embodiments or the prior art.

DETAILED DESCRIPTION OF ILLUSTRATIVE EMBODIMENTS

The following clearly and completely describes the technical solutions in the embodiments of the present disclosure with reference to the accompanying drawings in the embodiments of the present disclosure.

Figure 1:
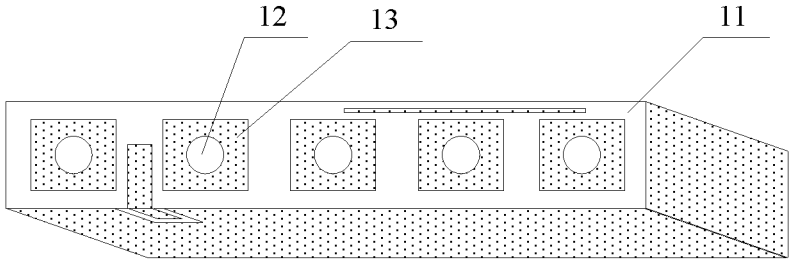
FIG. 1 Prior Art
FIG. 1 is a three-dimensional schematic diagram of a dielectric filter in the prior art.
Figure 2A:
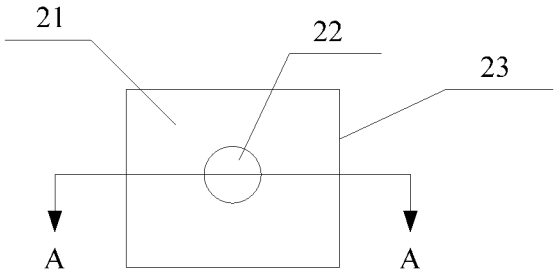
FIG. 2*a* is a top view of a dielectric resonator according to an embodiment of the present disclosure.
Figure 2B:
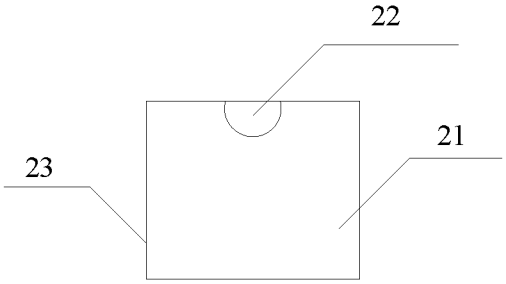
FIG. 2*b* is a cutaway drawing along an A-A direction of FIG. 2*a;*

An embodiment of the present disclosure provides a dielectric resonator, as shown in FIG. 2*a* and FIG. 2*b*, including a body 21 made of a solid-state dielectric material, where a dent 22 is disposed on a surface of the body 21, and the surface of the body 21 and a surface of the dent 22 are covered with a conducting layer 23.

In the dielectric resonator provided in this embodiment of the present disclosure, the dent on the body, and the conducting layer covering the surface of the body and the surface of the dent form a resonant cavity. A resonance mode inside the resonant cavity is a TM (transverse magnetic) mode, and an electric field direction of the mode is perpendicular to a body surface on which the dent is located. Because there is no inner conductor loss inside the resonant cavity, loss of the dielectric resonator is relatively small, so that a loss indicator of a dielectric filter using the dielectric resonator can meet a filtering requirement of a base station.

In the dielectric resonator provided in the foregoing embodiment, the number of dents is preferably one. When the number of dents increases, each dent and the conducting layer covering the dent and the body further form a sub-resonator of the resonator. A size, a shape, and a location of the dent determine a resonance frequency of the sub-resonator and an electric filed direction of a mode. An increasing number of sub-resonators makes more difficult to control a performance parameter of a resonator formed by combination. Generally, resonators are combined to form a filter; therefore, a commonly used resonator has only one dent.

In the dielectric resonator provided in the foregoing embodiment, the dielectric material is preferably ceramic. Ceramic has a larger dielectric constant (is 36), and is relatively good in both hardness and high temperature withstanding performance, thereby becoming a solid-state dielectric material commonly used in the field of radio frequency filters. Certainly, another material known by a person skilled in the art, such as glass, or an electrically insulated macromolecule polymer, may also be selected and used as the dielectric material.

It should be noted that: a shape of the dent of the dielectric resonator provided in the foregoing embodiment is not limited to a circle shown in FIG. 2*a* and FIG. 2*b*, and may also be a square or an irregular shape; a shape of the body is neither limited to a cube shown in FIG. 2*a* and FIG. 2*b*, and may also be a sphere or an irregular shape; and both the shape of the dent and the shape of the body may be selected according to an application scenario and a performance parameter requirement of the dielectric resonator.

Figure 3A:
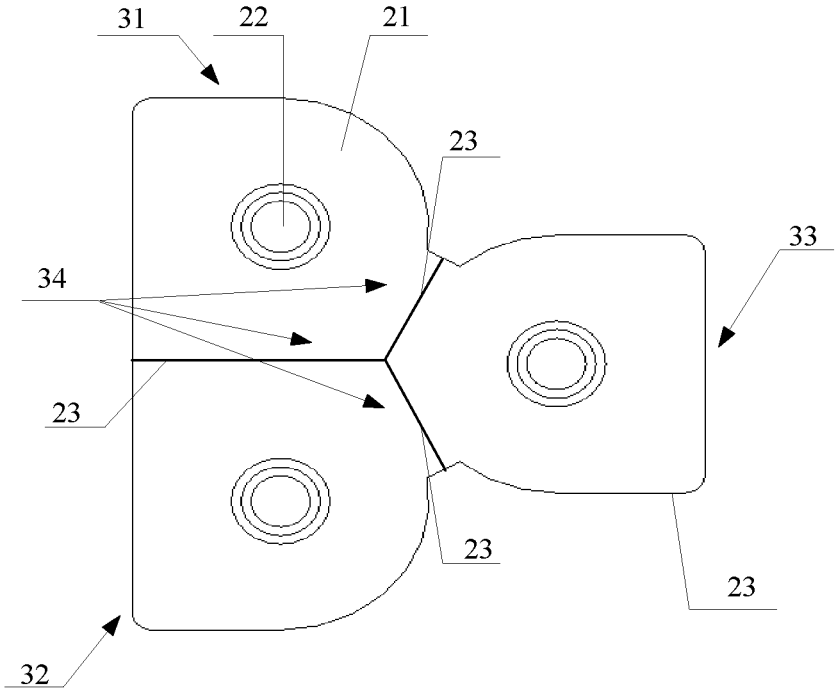
FIG. 3*a* is a top view of a dielectric filter according to an embodiment of the present disclosure.

An embodiment of the present disclosure further provides a dielectric filter, and as shown in FIG. 3*a*, the dielectric filter includes at least two dielectric resonators (31, 32, and 33). Similar to a structure of the dielectric resonator shown in FIG. 2*a* and FIG. 2*b*, a structure of the dielectric resonators (31, 32, and 33) includes a body 21 made of a solid-state dielectric material, a dent 22 that is disposed on a surface of the body 21, and a conducting layer 23 that covers the surface of the body 21 and a surface of the dent 22.

Further, adjacent dielectric resonators (31 and 32, 31 and 33, and 32 and 33) are fixedly connected by using joint faces 34, and conducting layers 23 of the joint faces 34 are connected together.

In the dielectric filter provided in this embodiment of the present disclosure, multiple dielectric resonators are used, adjacent dielectric resonators are fixedly connected to constitute a whole by using joint faces, and conducting layers of the joint faces of the adjacent dielectric resonators are connected together, for example, being connected together in a manner of welding, so that the adjacent dielectric resonators are electrically connected, and an electromagnetic wave signal can be propagated between the dielectric resonators. Same as the dielectric resonator shown in FIG. 2*a* and FIG. 2*b*, an inner resonance mode of each dielectric resonator is a TM mode, and an electric field direction of the mode is perpendicular to a body surface on which a dent is located, so that there is no loss of an inner conductor in a resonant cavity. Therefore, a loss indicator of the dielectric filter can be remarkably reduced, and the dielectric filter can be applied to a base station.

In addition, because the resonance mode of the dielectric resonators provided in this embodiment of the present disclosure is the TM mode, the dielectric filter that includes multiple dielectric resonators is also in the TM mode. Compared with an existing dielectric filter in a TEM mode, the dielectric filter in the TM mode has an advantage of small insertion loss.

In the dielectric filter described in the foregoing embodiment, the conducting layers 23 of the joint faces 34 fixedly connecting the adjacent dielectric resonators are connected together. When this fixed connection manner is implemented, each dielectric resonator included in the dielectric filter may be first made to cover, with a conducting layer 23, a whole outer surface of a body 21 of each dielectric resonator, and then the conducting layers 23 on the joint faces 34 fixedly connecting the adjacent dielectric resonators are connected together, which can not only implement fixed connection between the adjacent dielectric resonators, but also implement electric connection between the adjacent dielectric resonators by using the conducting layers 23.

It should be noted that: a shape of the body of each dielectric resonator in the dielectric filter provided in this embodiment of the present disclosure may be randomly selected according to a requirement, and there may be mutually matched grooves on the joint faces fixedly connecting the adjacent dielectric resonators, where the mutually matched grooves may form a spacing when the adjacent dielectric resonators are connected, the spacing may be a through hole, a blind hole, or a groove, and a shape and a size of the spacing are related to a coupling degree of the adjacent dielectric resonators.

Figure 3B:
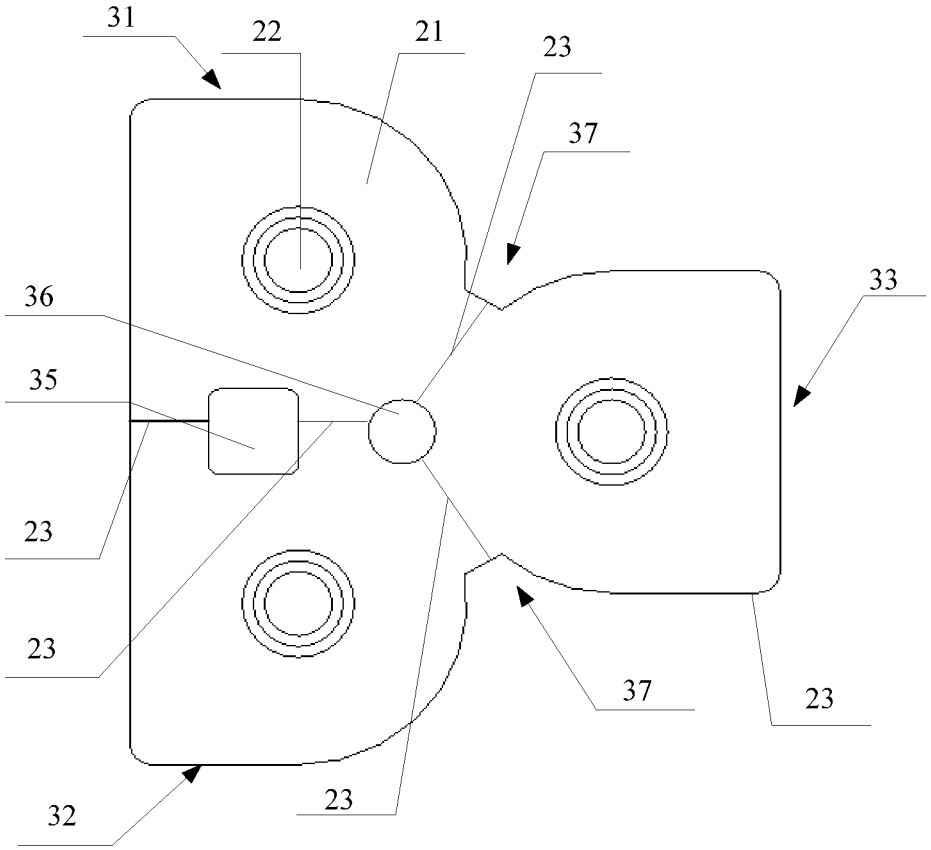
FIG. 3*b* is a top view of another dielectric filter according to an embodiment of the present disclosure.

FIG. 3*b* shows the spacings (35, 36, and 37), and the spacings (35, 36, and 37) are added to the dielectric filter shown in FIG. 3*b* based on the dielectric filter shown in FIG. 3*a*. On the joint faces 34, outer surfaces of the dielectric resonators come in contact with each other; and outer surfaces of the dielectric resonators at the spacings (35, 36, and 37) have grooves and therefore cannot come in contact with each other. The outer surfaces of the dielectric resonators are conducting layers, and therefore all interiors of the spacings are conducting layers 23. A shape of the spacings (35, 36, and 37) may be the aforementioned hole or groove, or another shape known by a person skilled in the art.

When preparation of the dielectric filter provided in the foregoing embodiment is completed, it is possible that a performance parameter cannot fully meet a use requirement. In this case, a resonance frequency of the dielectric filter may be adjusted in a manner of partially removing a conducting layer in the dent 22, or coupling between dielectric resonators may be adjusted in a manner of partially removing a conducting layer of an interior of a spacing.

Figure 4:
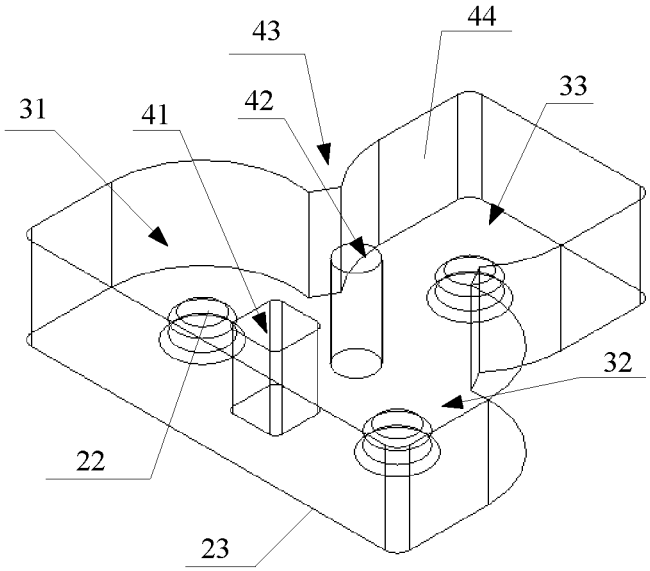
FIG. 4 is a three-dimensional perspective view of still another dielectric filter according to an embodiment of the present disclosure.

An embodiment of the present disclosure further provides a dielectric filter, and as shown in FIG. 4, the dielectric filter includes a body 44 made of a solid-state dielectric material, where at least two dents 22 are disposed on a surface of the body 44; holes (41 and 42) and/or a groove 43 is disposed between adjacent dents 22 on the body 44; and the surface of the body 44 is covered with a conducting layer 23. Further, one dent 22, the body 44 surrounding the one dent 22, and the conducting layer 23 surrounding the one dent 22 form a dielectric resonator. Further, the holes (41 and 42) and/or the groove 43 forms a coupled structure between adjacent dielectric resonators.

The dielectric filter shown in FIG. 4 is a deformed structure of the dielectric filter shown in FIG. 3*b*. Different from the dielectric filter, shown in FIG. 3*b*, with each dielectric resonator having an independent body, the dielectric filter shown in FIG. 4 only includes one body 44, where multiple dents 22 are disposed on the surface of the body 44, the surface of the body 44 is covered with the conducting layer 23; one dent 22 on the surface of the body 44, the body surrounding the one dent 22, and the conducting layer surrounding the one dent 22 may form one dielectric resonator. FIG. 4 shows three dielectric resonators (31, 32, and 33). The holes (41 and 42) and the groove 43 that are disposed on the body 44 serve as the coupled structure between the adjacent dielectric resonators (31 and 32, 32 and 33, and 33 and 31), and play a role of separating the adjacent dielectric resonators (31 and 32, 32 and 33, and 33 and 31). When a shape and a size of the holes (41 and 42) or the groove 43 change, a coupling degree between the adjacent dielectric resonators also changes correspondingly.

It can be seen from FIG. 4 that the body of each dielectric resonator in the dielectric filter is integrally formed, and a shape, a size, and a location of the dents 22, the holes (41 and 42), and the groove 43 that are on the body are pre-designed according to a performance parameter of the dielectric filter and are formed when the body is integrally formed. When a dielectric filter with this type of structure is implemented, a raw material (for example, pottery clay) for making a body may be first prepared, then the raw material is placed in a designed mold and fired to form an integral body (ceramic) of the dielectric filter, and finally, a conducting layer 23 is plated on a surface of the fired body, so that the surface of the body 44 is covered with the conducting layer 23.

Both the holes (41 and 42) and the groove 43 may be disposed on the body 44, or only the holes (41 and 42) may be disposed, or only the groove 43 may be disposed, which may be selected according to a performance parameter of a desired dielectric filter.

Because the surface of the body 44 is covered with the conducting layer 23, surfaces of interiors of the holes (41 and 42) and the groove 43 are the conducting layer 23.

When preparation for the dielectric filter shown in FIG. 4 is completed, it is possible that a performance parameter cannot fully meet a use requirement. In this case, a resonance frequency of the dielectric filter may be adjusted in a manner of partially removing the conducting layer in the dent 22, or coupling between the dielectric resonators may be adjusted in a manner of partially removing a conducting layer of an interior of the groove 43, or coupling between the dielectric resonators may be adjusted in a manner of partially removing a conducting layer of interiors of both the holes (41 and 42) and the groove 43.

As shown in FIG. 4, specifically, the hole 41 is a through hole with a square cross-section, while the hole 42 is a blind hole with a circular cross-section. Certainly, a cross-sectional shape of a hole may also be another irregular shape, where a specific shape may be selected according to the performance parameter of the dielectric filter.

Based on the foregoing descriptions of the implementation manners, a person skilled in the art may clearly understand that a preparation process of the dielectric filter in the present disclosure may be implemented by software plus necessary universal hardware or by hardware only. In most circumstances, the former is a preferred implementation manner. Based on such an understanding, the technical solutions of the preparation process of the dielectric filter in the present disclosure essentially, or the part contributing to the prior art may be implemented in a form of a software product. The computer software product is stored in a readable storage medium, for example, a floppy disk, a hard disk, or an optical disc of a computer, and includes several instructions for instructing a computer device (which may be a personal computer, a server, or a network device) to perform the preparation methods of the dielectric filter described in the embodiments of the present disclosure.

An embodiment of the present disclosure further provides a transceiver, including the dielectric filter described in the foregoing embodiments.

In the transceiver provided in this embodiment of the present disclosure, because the dielectric filter described in the foregoing embodiments is used, loss is remarkably reduced, and a filtering performance is remarkably improved.

An embodiment of the present disclosure further provides a base station, including the dielectric filter or the transceiver described in the foregoing embodiments.

In the base station provided in this embodiment of the present disclosure, because the dielectric filter described in the foregoing embodiments is used, loss is remarkably reduced, and a filtering performance is remarkably improved.

The foregoing descriptions are merely specific embodiments of the present disclosure, but are not intended to limit the protection scope of the present disclosure. Any variation or replacement readily figured out by a person skilled in the art within the technical scope disclosed in the present disclosure shall fall within the protection scope of the present disclosure. Therefore, the protection scope of the present disclosure shall be subject to the protection scope of the claims.

What is claimed is:

1. A dielectric resonator, comprising:

a body made of a solid-state dielectric material, wherein an indentation is disposed at a first surface of the body opposite a second surface of the body, wherein the indentation is associated with a resonant frequency of the dielectric resonator, and wherein the body has one or more joint faces disposed between the first surface and the second surface, wherein a portion of a joint face of the one or more joint faces forms a portion of a spacing, wherein the spacing is a curved indentation in a side of the body extending from the first surface to the second surface; and a conducting layer covering the first surface of the body and extending contiguously to cover a portion of a surface of the indentation and the one or more joint faces, wherein a coverage area, by the conducting layer, of the surface of the indentation is associated with the resonant frequency of the dielectric resonator.

2. The dielectric resonator according to claim 1, wherein only one indentation is disposed at the first surface of the body.

3. The dielectric resonator according to claim 1, wherein the solid-state dielectric material comprises ceramic.

4. A dielectric filter, comprising a plurality of dielectric resonators according to claim 1.

5. The dielectric filter according to claim 4, wherein adjacent dielectric resonators are fixedly connected by a joint face of the respective one or more joint faces, and wherein conducting layers of the joint faces are connected together.

6. The dielectric filter according to claim 5, wherein the portion of the spacing of the adjacent dielectric resonators are aligned and form a spacing between the adjacent dielectric resonators.

7. The dielectric filter according to claim 6, wherein the spacing is a hole or a groove.

8. A dielectric filter, comprising:

a body made of a solid-state dielectric material, wherein a plurality of indentations are disposed on a first surface of the body and a hole or a groove is disposed between adjacent indentations on the body, wherein the plurality of indentations are associated with a resonant frequency of the dielectric filter; and a conducting layer covering the surface of the body and extending contiguously to cover a portion of a surface of each indentation of the plurality of indentations wherein a coverage area, by the conducting layer, of the surface of each indentation of the plurality of indentations is associated with the resonant frequency of the dielectric filter;

wherein one or more joint faces are disposed between the adjacent indentations and extend between the first surface and a second surface opposite the first surface, and wherein the conducting layer extends contiguously from the first surface over the one or more joint faces, and wherein the hole or the groove is formed by indentations in portions of opposing joint faces of the one or more joint faces and extends from the first surface to the second surface.

9. The dielectric filter according to claim 8, wherein one indentation, a portion of the body surrounding the one indentation, and the conducting layer surrounding the one indentation form a dielectric resonator.

10. The dielectric filter according to claim 8, wherein the hole or the groove is disposed between adjacent indentations on the body and form a coupled structure between adjacent dielectric resonators.

11. The dielectric filter according to claim 8, wherein the hole or the groove forms a coupled structure between adjacent dielectric resonators.

12. The dielectric filter according to claim 8, wherein adjacent dielectric resonators are fixedly connected by the one or more joint faces, and conducting layers of the joint faces of the adjacent dielectric resonators are connected together.

13. The dielectric filter according to claim 12, wherein the hole or the groove is disposed between the adjacent dielectric resonators.

14. A transceiver, comprising:

a dielectric filter;

wherein the dielectric filter comprises a plurality of dielectric resonators;

wherein each of the dielectric resonators comprises a body made of a solid-state dielectric material;

wherein each of the dielectric resonators has an indentation disposed on a first surface of the body, wherein the indentation is associated with a resonant frequency of the respective dielectric resonator;

wherein each of the dielectric resonators has one or more joint faces extending between the first surface and a second surface opposite the first surface; and wherein each of the dielectric resonators has a conducting layer covering the surface of the body, and the one or more joint faces, and extending contiguously to cover a portion of a surface of the indentation, wherein a coverage area, by the conducting layer, of the surface of the indentation is associated with the resonant frequency of the respective dielectric resonator;

wherein each resonator of the plurality of dielectric resonators has a joint face of the respective one or more joint faces fixedly connected to another joint face of the one or more joint faces of another resonator of the plurality of dielectric resonators with the conducting layer on the joint face of the respective resonator connected to the conductive layer of the respective another joint face of the respective another resonator;

wherein the dielectric filter has a spacing that is at least partially formed by opposing joint faces of the one or more joint faces and that extends from the first surface to the second surface.

15. The transceiver according to claim 14, wherein only one indentation is disposed at the surface of the body of each of the dielectric resonators.

16. The transceiver according to claim 14, wherein a plurality of indentations are disposed on the surface of the body of each of the dielectric resonators.

17. The transceiver according to claim 14, wherein three adjacent dielectric resonators are fixedly connected by using joint faces, and conducting layers of the joint faces of the adjacent three dielectric resonators are connected together, and wherein the spacing is formed by curved indentations in the joint faces of the three adjacent dielectric resonators.

18. The transceiver according to claim 14, wherein the spacing is one of a hole or a groove disposed between adjacent indentations on the body.

19. The transceiver according to claim 18, wherein the hole or the groove forms a coupled structure between adjacent dielectric resonators.

* * * * *